US009681699B2

(12) United States Patent
Kalina et al.

(10) Patent No.: US 9,681,699 B2
(45) Date of Patent: Jun. 20, 2017

(54) FOOTWEAR-BASED GYMNASTICS TRAINING SYSTEM AND METHOD

(71) Applicants: Matthew H. Kalina, Cary, IL (US); Danielle S Tangorra, Arlington Heights, IL (US)

(72) Inventors: Matthew H. Kalina, Cary, IL (US); Danielle S Tangorra, Arlington Heights, IL (US)

( * ) Notice: Subject to any disclaimer, the term of this patent is extended or adjusted under 35 U.S.C. 154(b) by 0 days.

(21) Appl. No.: 14/864,188

(22) Filed: Sep. 24, 2015

(65) Prior Publication Data

US 2016/0183626 A1 Jun. 30, 2016

Related U.S. Application Data

(60) Provisional application No. 62/056,121, filed on Sep. 26, 2014.

(51) Int. Cl.
*A43B 5/00* (2006.01)
*A43B 1/00* (2006.01)

(52) U.S. Cl.
CPC ..... *A43B 5/00* (2013.01); *A43B 1/0054* (2013.01); *A43B 1/0081* (2013.01)

(58) Field of Classification Search
CPC ..... A43B 1/0054; A43B 1/0081; A43B 3/10; A43B 5/00; A43B 5/08
USPC ..... 36/112, 136
See application file for complete search history.

(56) References Cited

U.S. PATENT DOCUMENTS 3,041,743 A * 7/1962 Monsma ..... A41B 11/002 24/29
4,273,336 A * 6/1981 Larkey ..... A63B 69/0059 128/878
4,457,510 A * 7/1984 Pertschuk ..... A63B 23/0211 128/DIG. 15
4,747,779 A * 5/1988 Gerstung ..... A63B 21/0004 128/882
5,269,690 A * 12/1993 Zigon ..... A43B 3/0078 36/112
5,688,137 A * 11/1997 Bustance ..... A63B 69/0059 2/102
6,003,212 A * 12/1999 Imahata ..... A43C 11/00 24/324
7,166,083 B2 * 1/2007 Bledsoe ..... A61F 5/0116 602/23
7,246,455 B2 * 7/2007 Covington ..... A43B 3/0005 36/112

(Continued)

*Primary Examiner* — Marie Bays
(74) *Attorney, Agent, or Firm* — Charles F. Meroni, Jr.; Meroni & Meroni, P.C.

(57) ABSTRACT

A footwear-based gymnastics-training device for enabling a user to temporarily retain the user's feet in a together position, the footwear-based gymnastics-training device. The device having a pair of footwear constructions, the pair of footwear constructions being a left foot construction and a right foot construction, the left and right foot constructions being outfittable upon the user's left and right feet. Matable temporary fastening means are cooperably associated with the left and right foot constructions for temporarily fastening the left and right foot constructions together when outfitted upon the user's left and right feet, the pair of footwear constructions and matable temporary fastening means thus being cooperable for temporarily retaining the user's feet in the together position.

25 Claims, 4 Drawing Sheets

(56) References Cited

U.S. PATENT DOCUMENTS

| | | | | |
|---|---|---|---|---|
| 7,346,935 | B1 * | 3/2008 | Patterson | A41B 11/004 2/239 |
| 7,676,850 | B2 * | 3/2010 | Steel | A41B 11/004 2/239 |
| 7,934,325 | B2 * | 5/2011 | Sokolowski | A43B 3/126 36/113 |
| 8,448,350 | B2 * | 5/2013 | Nataadiningrat | A43B 5/12 36/8.3 |
| 8,973,162 | B1 * | 3/2015 | Bretan | A41D 13/06 2/22 |
| 2005/0011083 | A1 * | 1/2005 | Kosted | A43B 1/0081 36/9 R |
| 2010/0011486 | A1 * | 1/2010 | Allen | A41B 11/002 2/239 |
| 2010/0299809 | A1 * | 12/2010 | Mazzarolo | A43B 1/0054 2/239 |
| 2012/0124867 | A1 * | 5/2012 | Heinrich | A43B 1/0054 36/136 |
| 2015/0211174 | A1 * | 7/2015 | Tan | D06F 95/008 2/69 |
| 2016/0183626 | A1 * | 6/2016 | Kalina | A43B 1/0054 36/114 |

* cited by examiner

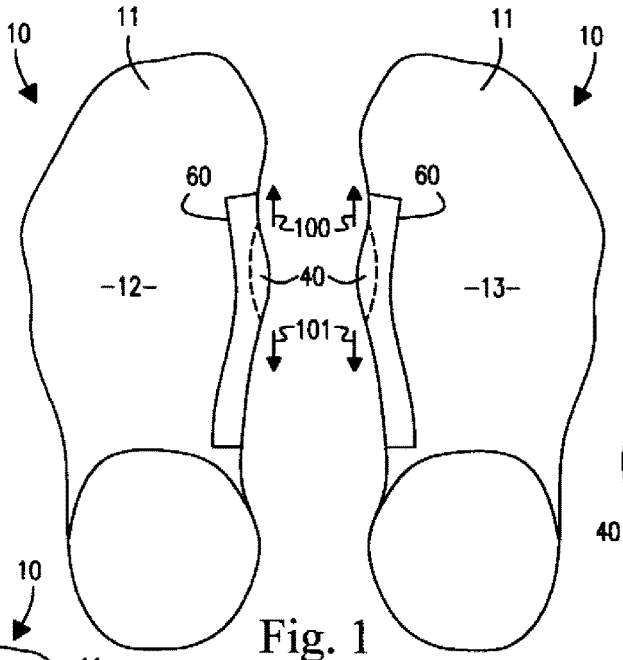
Fig. 1
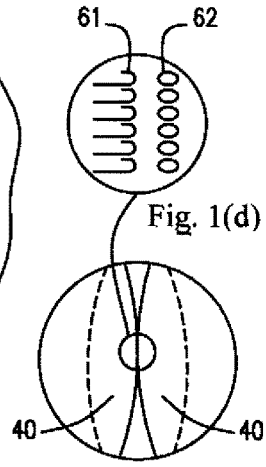
Fig. 1(d)
Fig. 1(b)
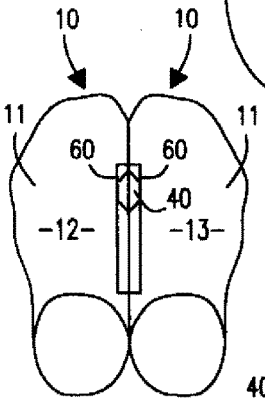
Fig. 1(a)
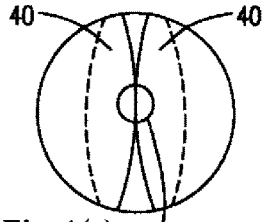
Fig. 1(c)
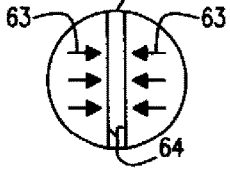
Fig. 1(e)
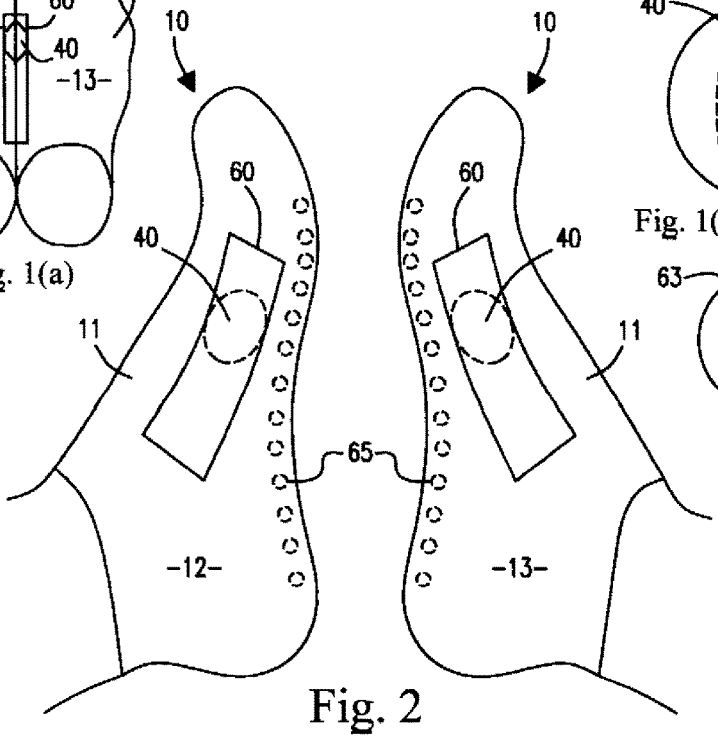
Fig. 2

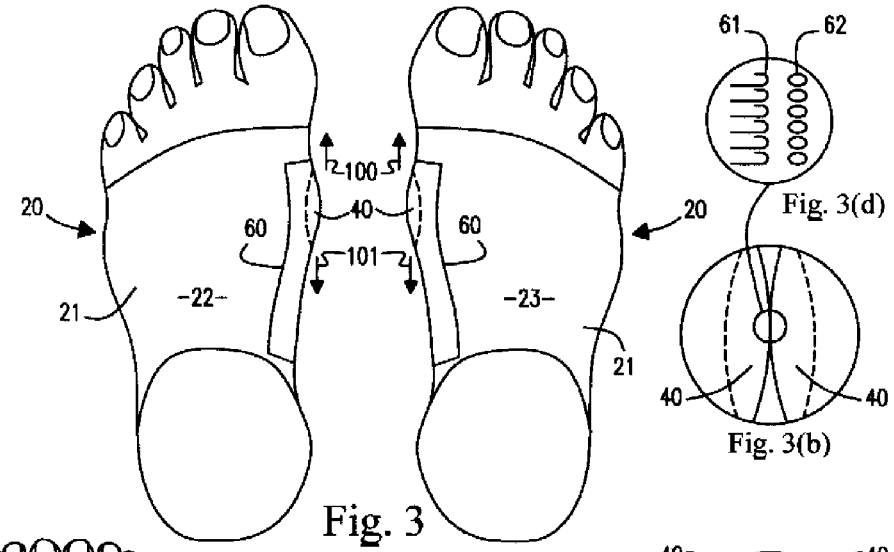
Fig. 3
Fig. 3(d)
Fig. 3(b)
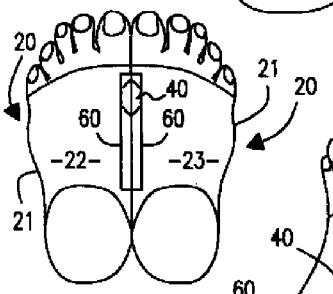
Fig. 3(a)
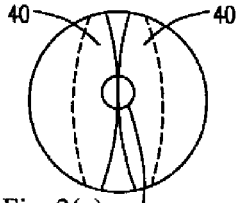
Fig. 3(c)
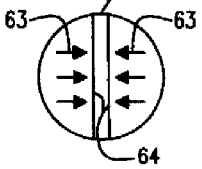
Fig. 3(e)
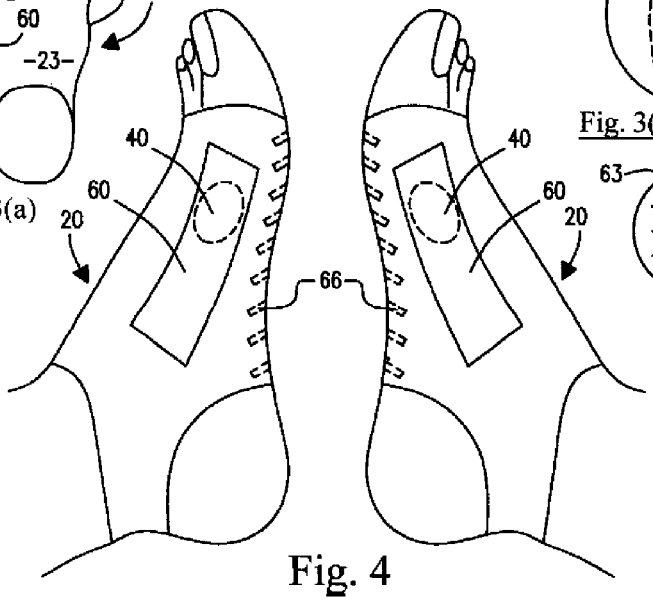
Fig. 4

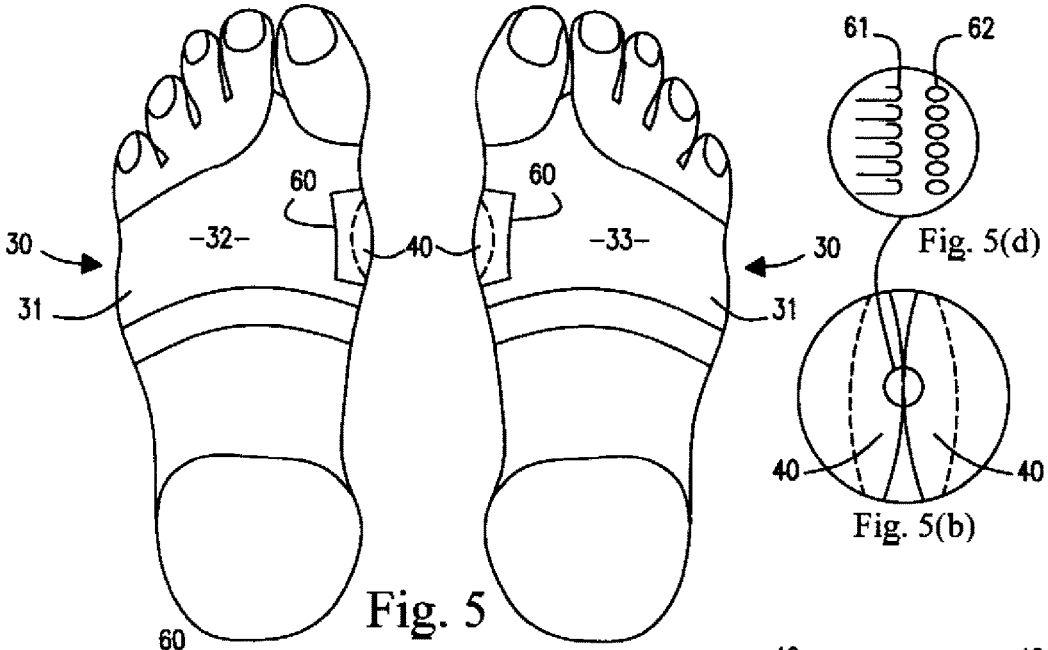
Fig. 5
Fig. 5(d)
Fig. 5(b)
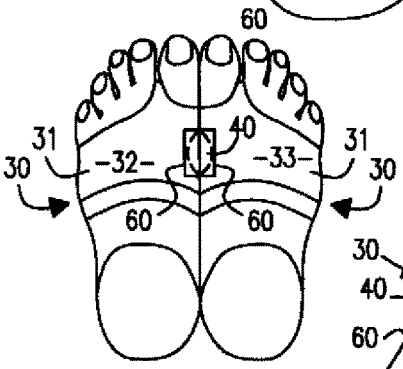
Fig. 5(a)
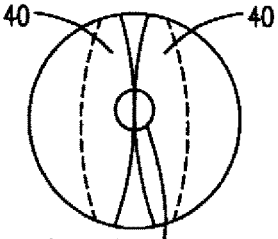
Fig. 5(c)
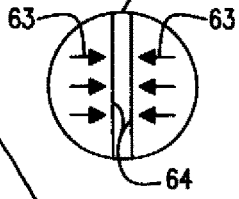
Fig. 5(e)
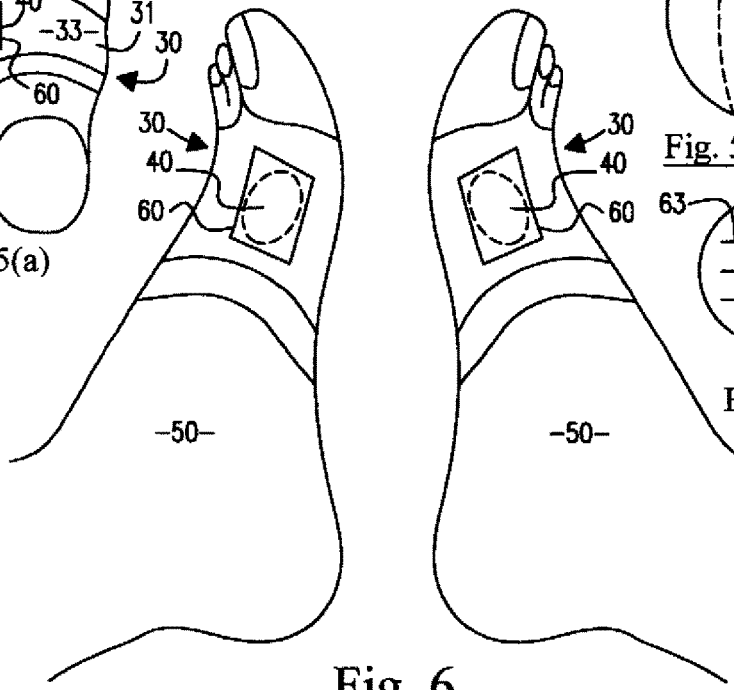
Fig. 6

FOOTWEAR-BASED GYMNASTICS TRAINING SYSTEM AND METHOD

This application claims the benefit of U.S. Provisional Application No. 62/056,121, filed Sep. 26, 2014.

BACKGROUND OF THE INVENTION

Field of the Invention

The present invention relates generally to certain means for outfitting a user's feet for selectively enabling a temporary fastened relationship of the user's feet. More particularly, the present invention relates to a footwear-based gymnastics-training device and/or method for enabling a user to temporarily retain the user's feet in a together position.

Brief Description of the Prior Art

U.S. Pat. No. 5,038,413 ('413 Patent), which issued to Ursino, discloses certain Sock Fastening Means. The '413 Patent describes a fastening device for securing a pair of socks together includes a first fastener attached to one sock of the pair and a second fastener attached to the other sock of the pair, said fasteners being releasably engageable with one another. The fastening device prevents the loss of socks due to separation from one another and the inconsistent pairing of socks of a similar type.

U.S. Pat. No. 5,321,855 ('855 Patent), which issued to Ciuffo, discloses a Fastening System for Pairing Socks, Hosiery and Gloves. The '855 Patent describes an improved hook and loop reusable and reclosable fastening system for pairing socks, hosiery and gloves. The fastening system is permanently attached to the socks and hosiery. A preferred embodiment includes an elastic or other stretchable backing material attached to each hook and loop panel preferably made up of thin separable strips which can move with the expansion and contraction of the sock and attachment material.

Another preferred embodiment includes several thin strips of the hook and loop panels attached directly to each sock, so that the sock itself can serve as a stretchable backing material. Another preferred embodiment is that each hook and loop panel, respectively, is attached to a logo or decorative pattern on the sock to camouflage the particular hook and loop panel. The products, such as socks, hosiery, gloves and the like can be attached by the hook and loop attachment means for washing, drying and storage. The VELCRO type fasteners are able to withstand the high temperature and forces encountered during the washing and drying process.

U.S. Pat. No. 5,699,557 ('557 Patent), which issued to Johnson, discloses an Embroidered Applique Fastening System Clothing Articles. The '557 Patent describes a pair of fastening hook-and-loop patches, consisting of a flexible and decorative hook patch and a flexible and decorative loop patch is permanently attached to a mated pair of complementary items by embroidery which provides enhanced attachment and resistance to curling and inadvertent disassociation with the article of clothing.

The mated pairs of complementary items may include articles of clothing or other articles of manufacture. The decorative embroidered applique patches on a single pair of complementary items are unique and aid in mating assorted individual complementary items based on the shape and color of the fastening patch embroidered to the complementary item. The decorative nature of the patches is useful in attracting a child's attention to the fastening device, which results in the child's interest in participation in mating items, such as socks, which may be separated their complementary mates.

U.S. Pat. No. 5,740,558 ('558 Patent), which issued to Messman, discloses certain Means for Attaching Articles Together. The '558 Patent describes a device for attaching flexible articles, such as clothing items having an edge. The device includes a flexible strip which includes an end with a sewable edge, and a second end having a fastening device. The device may be sown to an edge of the flexible article, such as a pair of socks, allowing the user to temporarily join a pair of socks, for example, by taking at least two of the flexible strips and stitching the sewable edge of each flexible strip to an edge of each of the socks of a pair of socks. This allows the fastening of the second end of one flexible strip to the second end of the other flexible strip, so that the clothing items may be secured together when they are not being worn.

U.S. Pat. No. 5,918,318 ('318 Patent), which issued to Jones, describes an Attachment Device for Clothing Items. The '318 Patent discloses an attachment device for releasably securing first and second clothing items which comprises a first tab and a second tab each including mating hook and loop fastening elements which are mounted to respective clothing items in an orientation wherein the hook and loop fastening elements of the first tab engage and releasably connect to the hook and loop fastening elements of the second tab such that forces tending to separate the first and second clothing items during laundering result in the application of a shear force to the connected tabs.

U.S. Pat. No. 5,970,524 ('524 Patent), which issued to Becker et al., describes a Pair of Separably Joined Socks or Stockings. The '524 Patent discloses a pair of socks or stockings which may be joined together in a detachable fashion using a set heat-resistant, transparent fastening elements, in order to avoid sorting of the socks or stockings, e.g., after washing. Each of said fastening elements is firmly attached to a stocking or sock, preferably at its leg portion, in an area of the sock or stocking having a mesh density of at least 2000 MD, preferably at least 4000 MD.

U.S. Pat. No. 6,032,294 ('294 Patent), which issued to Dean., describes a Fastener for Mating Pairs of Clothing Items. The '294 Patent discloses a sock pair or glove pair having a first and a second sock or glove and at least one snap fastener. Each snap fastener has a male part, a female part, and two securing parts. At least one snap fastener is a retaining snap fastener. Each sock or glove has a U-shaped fabric tab folded over the upper or wrist edge of the sock or glove. The tab is retained on the sock or the glove by the male or the female part and one of the securing parts of the retaining snap fastener.

The retaining snap fastener is located at a fastener distance from the upper or wrist edge of the sock or glove. The fastener distance is at least the fastener width and may be up to 2.5 times the fastener width. At least one of the tabs has an indicia indicating the source of the sock or glove. The inner and outer distal edges of each tab preferably conform to the shape of the snap fastener holding the tab on. The glove or sock pair is comfortable, durable, and particularly suited for inexpensive mass production by machine. The pair can be easily mated when desired for laundering or storage.

SUMMARY OF THE INVENTION

To achieve the aforementioned and other readily apparent objectives, the present invention essentially provides a footwear-based gymnastics-training device and/or method for enabling a user to temporarily retain the user's feet in a together position for proper technique for form during training exercise(s). The footwear-based gymnastics-training device and/or method according to the present invention may be said to preferably comprise a pair of footwear constructions. The pair(s) of footwear constructions according to the present invention each preferably comprise a left foot construction, and a right foot construction. The left and right foot constructions are outfittable upon the user's left and right feet.

Certain matable temporary fastening means are cooperably associated with the left and right foot constructions for temporarily fastening the left and right foot constructions together when outfitted upon the user's left and right feet. The pair of footwear constructions together with the matable temporary fastening means are thus cooperable for temporarily retaining the user's feet (and by extension the user's legs) in the together position for enhancing proper technique during training exercises.

The matable temporary fastening means may be preferably exemplified by comprising or matable hook and loop fastening structures or magnetic means for forced attraction or magnetically attractive fastening structures such as or exemplified by magnets. Any number of different types of footwear constructions are contemplated as may be based upon certain state of the art foundational feet-covering or foot-adorning footwear, including but not limited to closed-toe—closed-heel type foot constructions; open-toe—open-heel type foot constructions; foot-thong type foot constructions; and foot-thong with elastic heel band type foot constructions.

The left foot construction and the right foot construction may further preferably comprise certain construction-to-surface gripping means for increasing the coefficient of friction intermediate the left and right footwear constructions and an underlying training surface. The gripping means may be preferably exemplified by polymeric knob-like protrusions or polymeric raised ridge type constructions for increasing the coefficient of friction intermediate a wearer's footwear construction-adorned feet and an underlying training surface as exemplified by a gymnasium floor.

The left and right foot constructions according to the present invention each preferably comprise a medial, superficial, metatarsal-to-phalange junction sites cooperably associated with the matable temporary fastening means. The matable temporary fastening means are anatomically shaped so as to maximize the contact surface area and minimize foot-to-foot obstructions between the left and right footwear constructions. The matable temporary fastening means extend anteriorly and posteriorly from the medial, superficial, metatarsal-to-phalange junction sites for enabling the user's left and right feet to anatomically and matably adjust during training exercises.

A preferred embodiment of the invention is a footwear-based gymnastics-training method for enabling a user to temporarily retain the user's feet in a together position having the steps of providing a pair of footwear constructions, the pair of footwear constructions comprising a left foot construction and a right foot construction, equipping a user's left foot and a user's right foot with the left and right foot constructions positioning the user's left foot and a user's right foot such that the left and right foot constructions are in contact along a set of matable temporary fastening means and performing a gymnastics training exercise while retaining the user's left and right feet in a together position via the matable temporary fastening means.

BRIEF DESCRIPTION OF THE DRAWINGS

Other features of our invention will become more evident from a consideration of the following brief descriptions of patent drawings:

FIG. 1 is a diagrammatic top plan type depiction of a pair of laterally spaced human feet outfitted with a pair of first (closed toe—closed heel) footwear constructions according to the present invention.

FIG. 1(*a*) is a reduced diagrammatic top plan type depiction of the pair of outfitted feet otherwise depicted in FIG. 1 drawn together and mated at medial foot-to-foot junction site(s).

FIG. 1(*b*) is a first enlarged fragmentary view of medial foot-to-foot junction site(s) from FIG. 1(*a*) for further correspondence with FIG. 1(*d*).

FIG. 1(*c*) is a second enlarged fragmentary view of medial foot-to-foot junction site(s) from FIG. 1(*a*) for further correspondence with FIG. 1(*e*).

FIG. 1(*d*) is a diagrammatic depiction of generic hook and loop type matable fastening structures representative of the type of matable fastening means from FIG. 1(*b*).

FIG. 1(*e*) is a diagrammatic depiction of generic magnetic type matable fastening structures representative of the type of matable fastening means from FIG. 1(*c*).

FIG. 2 is a diagrammatic medial type view or depiction of a pair of laterally spaced human feet outfitted with a pair of first (closed toe—closed heel) footwear constructions according to the present invention.

FIG. 3 is a diagrammatic top plan type depiction of a pair of laterally spaced human feet outfitted with a pair of second (open toe—open heel) footwear constructions according to the present invention.

FIG. 3(*a*) is a reduced diagrammatic top plan type depiction of the pair of outfitted feet otherwise depicted in FIG. 3 drawn together and mated at medial foot-to-foot junction site(s).

FIG. 3(*b*) is a first enlarged fragmentary view of medial foot-to-foot junction site(s) from FIG. 3(*a*) for further correspondence with FIG. 3(*d*).

FIG. 3(*c*) is a second enlarged fragmentary view of medial foot-to-foot junction site(s) from FIG. 3(*a*) for further correspondence with FIG. 3(*e*).

FIG. 3(*d*) is a diagrammatic depiction of generic hook and loop type matable fastening structures representative of the type of matable fastening means from FIG. 3(*b*).

FIG. 3(*e*) is a diagrammatic depiction of generic magnetic type matable fastening structures representative of the type of matable fastening means from FIG. 3(*c*).

FIG. 4 is a diagrammatic medial type view or depiction of a pair of laterally spaced human feet outfitted with a pair of second (open toe—open heel) footwear constructions according to the present invention.

FIG. 5 is a diagrammatic top plan type depiction of a pair of laterally spaced human feet outfitted with a pair of third (foot thong type) footwear constructions according to the present invention.

FIG. 5(*a*) is a reduced diagrammatic top plan type depiction of the pair of outfitted feet otherwise depicted in FIG. 5 drawn together and mated at medial foot-to-foot junction site(s).

FIG. 5(*b*) is a first enlarged fragmentary view of medial foot-to-foot junction site(s) from FIG. 5(*a*) for further correspondence with FIG. 5(*d*).

FIG. 5(*c*) is a second enlarged fragmentary view of medial foot-to-foot junction site(s) from FIG. 5(*a*) for further correspondence with FIG. 5(*e*).

FIG. 5(*d*) is a diagrammatic depiction of generic hook and loop type matable fastening structures representative of the type of matable fastening means from FIG. 5(*b*).

FIG. 5(*e*) is a diagrammatic depiction of generic magnetic type matable fastening structures representative of the type of matable fastening means from FIG. 5(*c*).

FIG. 6 is a diagrammatic medial type view or depiction of a pair of laterally spaced human feet outfitted with a pair of third (foot thong type) footwear constructions according to the present invention.

DETAILED DESCRIPTION OF THE PREFERRED EMBODIMENT AND METHODOLOGY

Figure 7:
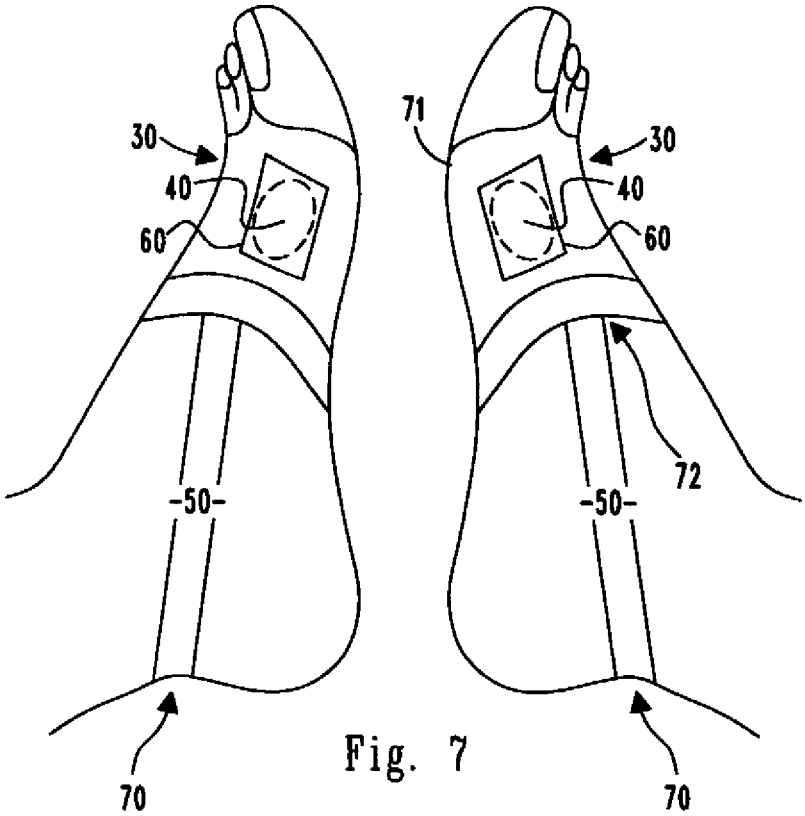
FIG. 7 is a diagrammatic medial type view or depiction of a pair of laterally spaced human feet outfitted with a pair of fourth (foot thong with elastic band type) footwear constructions according to the present invention.

Referring now to the drawings with more specificity, the preferred embodiments of the present invention primarily concern various types of footwear constructions as exemplified by several different types of footwear constructions as at 10, 20, and 30 in FIGS. 1-7 inclusive. FIGS. 1 and 2 depict a pair of human feet outfitted with a pair of first (closed toe—closed heel) footwear constructions 10 according to the present invention. FIGS. 3 and 4 depict a pair of second (open toe—open heel) footwear constructions 20 according to the present invention. FIGS. 5 and 6 depict a pair of third (foot thong type) footwear constructions 30 according to the present invention. FIG. 7 depicts a pair of fourth (foot thong with elastic band) footwear constructions 30 according to the present invention.

The central aspect of the present invention is providing matable temporary fastening means 60 at the medial portion of a footwear construction in superficial adjacency to the junction of the first metatarsal bone and the phalange section of the big toe as at site 40, which matable temporary fastening means may extend anteriorly and posteriorly from site 40 as at 100 and 101 respectively, for enabling the user's left and right feet to anatomically and matably adjust during training exercises. The matable temporary fastening means 60 may be of a type that temporarily fastens the paired footwear constructions 10, 20, or 30 (as outfitted upon the human feet 50 inserted therein) together for training gymnasts and the like to maintain their feet 50 (and legs by extension) in a together position (i.e. the medial portions of the feet 50 being brought together such that those sites 40 in superficial adjacency to the junction of the first metatarsal bone and the phalange sections are touching one another) as generally depicted in FIGS. 1(*a*), 3(*a*), and 5(*a*).

It is contemplated that the matable temporary fastening means 60 according to the present invention may be preferably exemplified by hook (as at 61) and loop (as at 62) fastening structure or means (Velcro® brand), or certain magnetic means for magnetically attracting (as at force vectors 63) and holding opposed sites 40 in contact with one another as generally and comparatively depicted in FIGS. 1(*b*)-1(*e*); 3(*b*)-3(*e*); and 5(*b*)-5(*e*). The matable hook and loop fastening structure(s) 61/62 and magnetic means for forced attraction as at force vectors 63 and provided by magnet constructions 64 may be preferably outfitted upon (stitched onto or otherwise fastened to) state of the art footwear constructions typified by closed-toe—closed-heel type footwear constructions as at 11; open-toe—open heel type footwear constructions as at 21; foot thong type footwear constructions as at 31; or foot thong with band (70) type footwear constructions as at 71. In at least one preferred embodiment, band 70 is connected to footwear 30 at connection point 72.

The state of the art footwear constructions typified by closed-toe—closed-heel type footwear constructions as at 11; open-toe—open heel type footwear constructions as at 21; foot thong type footwear constructions as at 31; and/or foot thong with band type footwear constructions as at 71, may be further preferably outfitted with certain gripping means as exemplified by polymeric knob-like protrusions 65 or polymeric raised ridge type constructions as at 66 for increasing the coefficient of friction intermediate a wearer's construction-adorned feet 50 and an underlying (e.g. gymnasium) surface (not specifically illustrated).

It will be understood from a consideration of the drawings being submitted in support of these specifications that the left foot construction(s) 12, 22, and 32; and right foot constructions 13, 23, and 33 each comprise a medial, superficial, metatarsal-to-phalange junction site upon or which site the sites 40 appear, and thus the matable temporary fastening means are cooperably associated with the medial, superficial, metatarsal-to-phalange junction sites. The matable temporary fastening means 60 are preferably anatomically shaped to conform to the medial, superficial, metatarsal-to-phalange junction sites so as to maximize effective contact surface area while minimizing left foot-to-right foot or foot-to-foot obstructions between the left footwear constructions 12, 22, and 32 versus and right footwear constructions 13, 23, and 33.

While the foregoing specifications set forth much specificity, the same should not be construed as setting forth limits to the invention but rather as setting forth certain preferred embodiments and features. For example, as prefaced hereinabove, it is contemplated that the present invention essentially provides a footwear-based gymnastics-training device and/or method for enabling a user to temporarily retain the user's feet in a together position for proper technique for form during training exercise(s).

The footwear-based gymnastics-training device and/or method according to the present invention may be said to preferably comprise a pair of footwear constructions as exemplified at 10, 20, and/or 30. The pair(s) of footwear constructions each preferably comprise a left foot construction as at 12, 22, and 32; and a right foot construction as at 13, 23, and 33. The left and right foot constructions are outfittable upon the user's left and right feet as at 50.

Certain matable temporary fastening means as at 60 are cooperably associated with the left and right foot constructions for temporarily fastening the left and right foot constructions together when outfitted upon the user's left and right feet. The pair of footwear constructions together with the matable temporary fastening means are thus cooperable for temporarily retaining the user's feet (and by extension the user's legs) in the together position (as generally depicted in FIGS. 1(*a*), 3(*a*), and 5(*a*) for enhancing proper technique during training exercises.

The matable temporary fastening means 60 may be preferably exemplified by comprising or matable hook and loop fastening structures as at 61/62 or magnetic means for forced attraction 63 or magnetically attractive fastening structures such as or exemplified by magnets as at 64. Any number of different types of footwear constructions are contemplated as may be based upon certain state of the art foundational feet-covering or foot-adorning footwear, including but not limited to closed-toe—closed-heel type foot constructions as generally depicted in FIGS. 1 and 2; open-toe—open-heel type foot constructions as generally depicted in FIGS. 3 and 4; foot-thong type foot constructions as generally depicted in FIGS. 5 and 6; and foot thong with elastic band footwear constructions as generally depicted in FIG. 7.

The left foot construction and the right foot construction may further preferably comprise certain construction-to-surface gripping means for increasing the coefficient of friction intermediate the left and right footwear constructions and an underlying training surface. The gripping means may be preferably exemplified by polymeric knob-like protrusions 65 or polymeric raised ridge type constructions as at 66 for increasing the coefficient of friction intermediate a wearer's footwear construction-adorned feet 50 and an underlying training surface as exemplified by a gymnasium floor. The left and right foot constructions according to the present invention each preferably comprise a medial, superficial, metatarsal-to-phalange junction sites cooperably associated with the matable temporary fastening means. The matable temporary fastening means are anatomically shaped so as to maximize the contact surface area and minimize foot-to-foot obstructions between the left and right footwear constructions. The matable temporary fastening means extend anteriorly and posteriorly from the medial, superficial, metatarsal-to-phalange junction sites for enabling the user's left and right feet to anatomically and matably adjust during training exercises.

Accordingly, although the invention has been described by reference to certain preferred embodiments and certain methodology, it is not intended that the novel arrangement and methods be limited thereby, but that modifications thereof are intended to be included as falling within the broad scope and spirit of the foregoing disclosures, the appended drawings, and the following provisionally-drafted patent claims.

We claim:

1. A footwear-based gymnastics-training device for enabling a user to temporarily retain the user's feet in a together position, the footwear-based gymnastics-training system, comprising:

a pair of footwear constructions, the pair of footwear constructions comprising a left foot construction and a right foot construction, the left and right foot constructions being outfittable upon the user's left and right feet; and matable temporary fastening means cooperably associated with the left and right foot constructions for temporarily fastening the left and right foot constructions together when outfitted upon the user's left and right feet, the temporary fastening means located on the interior side of the footwear constructions at the metatarsal-to-phalange junction sites and having a convex ball shape, the pair of footwear constructions and matable temporary fastening means thus being cooperable for temporarily retaining the user's feet in the together position.

2. The footwear-based gymnastics-training device of claim 1 wherein the matable temporary fastening means comprise matable hook and loop fastening structures.

3. The footwear-based gymnastics-training device of claim 1 wherein the matable temporary fastening means comprise magnetically attractive fastening structures.

4. The footwear-based gymnastics-training device of claim 1 wherein the left foot construction and the right foot construction are closed-toe—closed-heel type foot constructions.

5. The footwear-based gymnastics-training device of claim 1 wherein the left foot construction and the right foot construction are open-toe—open-heel type foot constructions.

6. The footwear-based gymnastics-training device of claim 1 wherein the left foot construction and the right foot construction are foot-thong foot constructions.

7. The footwear-based gymnastics-training device of claim 6 further comprising a band on each foot-thong foot constructions attached to the foot-thong constructions for securing the user's feet.

8. The footwear-based gymnastics-training device of claim 1 wherein the left foot construction and the right foot construction are foot-thong with elastic band foot constructions.

9. The footwear-based gymnastics-training device of claim 1 wherein the left foot construction and the right foot construction comprise construction-to-surface gripping means for increasing the coefficient of friction intermediate the left and right footwear constructions and an underlying training surface.

10. The footwear-based gymnastics-training device of claim 1 wherein the left and right foot constructions each comprise a a single toe band traversing between the hallux and the adjacent toe for securing the foot constructions in place along both the medial-lateral and frontal-distal axes.

11. The footwear-based gymnastics-training device of claim 10 wherein the matable temporary fastening means are anatomically shaped and deformable so as to maximize the contact surface area and minimize foot-to-foot obstructions between the left and right footwear constructions.

12. The footwear-based gymnastics-training device of claim 1 wherein the matable temporary fastening means extend anteriorly and posteriorly from the metatarsal-to-phalange junction sites for enabling the user's left and right feet to anatomically and matably adjust during training exercises.

13. A footwear-based gymnastics-training method for enabling a user to temporarily retain the user's feet in a together position, the footwear-based gymnastics-training method, comprising the steps of:

providing a pair of footwear constructions, the pair of footwear constructions comprising a left foot construction and a right foot construction;

outfitting the left foot construction and the right foot construction with matable temporary fastening means for temporarily fastening the left and right foot constructions together when outfitted upon a user's left and right feet the temporary fastening means located on the interior side of the footwear constructions at the metatarsal-to-phalange junction sites and having a convex ball shape;

outfitting a user's left foot and a user's right foot with the matable temporary fastening means-outfitted left and right foot constructions; and temporarily retaining the user's feet in the together position via the matable temporary fastening means-outfitted left and right foot constructions.

14. The footwear-based gymnastics-training method of claim 13 wherein the matable temporary fastening means comprise matable hook and loop fastening structures.

15. The footwear-based gymnastics-training method of claim 13 wherein the matable temporary fastening means comprise magnetically attractive fastening structures.

16. The footwear-based gymnastics-training method of claim 13 wherein the left foot construction and the right foot construction are closed-toe—closed-heel type foot constructions.

17. The footwear-based gymnastics-training method of claim 13 wherein the left foot construction and the right foot construction are open-toe—open-heel type foot constructions.

18. The footwear-based gymnastics-training method of claim 13 wherein the left foot construction and the right foot construction are foot-thong foot constructions.

19. The footwear-based gymnastics-training system of claim 18 wherein each of the foot-thong foot constructions further comprises a band on each foot-thong foot constructions attached to the foot-thong constructions for securing the user's feet.

20. The footwear-based gymnastics-training system of claim 13 wherein the left foot construction and the right foot construction are foot-thong with elastic band foot constructions.

21. The footwear-based gymnastics-training method of claim 11 wherein the left foot construction and the right foot construction comprising construction-to-surface gripping means for increasing the coefficient of friction intermediate the left and right footwear constructions and an underlying training surface.

22. The footwear-based gymnastics-training method of claim 21 wherein the construction-to-surface gripping means comprise polymeric knob-like protrusions.

23. The footwear-based gymnastics-training method of claim 13 wherein the matable temporary fastening means are anatomically shaped so as to maximize the contact surface area and minimize foot-to-foot obstructions between the left and right footwear constructions.

24. The footwear-based gymnastics-training method of claim 11 further comprising freeing the user's feet from the together position by releasing the fastening means-outfitted on the left and right foot constructions.

25. A footwear-based gymnastics-training method for enabling a user to temporarily retain the user's feet in a together position, the footwear-based gymnastics-training method, comprising the steps of:

providing a pair of footwear constructions, the pair of footwear constructions comprising a left foot construction and a right foot construction;

equipping a user's left foot and a user's right foot with the left and right foot constructions;

positioning the user's left foot and a user's right foot such that the left and right foot constructions are in contact along a set of matable temporary fastening mean the temporary fastening means located on the interior side of the footwear constructions at the metatarsal-to-phalange junction sites and having a convex ball shape; and performing a gymnastics training exercise while retaining the user's left and right feet in a together position via the matable temporary fastening means.

* * * * *